United States Patent [19]

Bakker et al.

[11] Patent Number: 4,745,856

[45] Date of Patent: May 24, 1988

[54] HYDRAULIC REFUSE COMPACTOR WITH CHANNEL GUIDED COMPACTOR BLADE

[76] Inventors: David P. Bakker, 8101 W. 79th St., Justice, Ill. 60458; David W. Van Sickle, 2925 W. 102nd St.; John Bakker, 3248 W. 97th St., both of Evergreen Park, Ill. 60642

[21] Appl. No.: 7,999

[22] Filed: Jan. 29, 1987

[51] Int. Cl.[4] ..... D05B 15/04; D05B 15/06

[52] U.S. Cl. ..... 100/249; 100/295

[58] Field of Search ..... 100/245, 240, 241, 269 R, 100/100, 295, 215, 249

[56] References Cited

U.S. PATENT DOCUMENTS

| | | | |
|---|---|---|---|
| 2,816,502 | 12/1957 | Eismann . | |
| 3,273,728 | 9/1966 | Kelso | 100/245 |
| 3,583,011 | 6/1971 | Maurer et al. | 100/2 |
| 3,625,140 | 12/1971 | Glanz . | |
| 3,739,715 | 6/1973 | Ambrose . | |
| 3,750,562 | 8/1973 | Jureit . | |
| 3,815,323 | 6/1974 | Longo . | |
| 3,828,663 | 8/1974 | Poplinski | 100/245 X |
| 3,844,209 | 10/1974 | Allbritton . | |
| 3,880,072 | 4/1975 | Ord . | |
| 4,057,010 | 11/1977 | Smith . | |
| 4,103,608 | 8/1978 | Chenot . | |
| 4,258,766 | 3/1981 | Van Dijk | 100/295 |
| 4,415,824 | 3/1979 | Watson . | |
| 4,467,712 | 8/1984 | Fincham . | |
| 4,483,248 | 11/1984 | Ostreng . | |
| 4,548,131 | 10/1987 | Williams . | |

FOREIGN PATENT DOCUMENTS

| | | | |
|---|---|---|---|
| 2152881 | 5/1981 | Fed. Rep. of Germany | 100/100 |
| 2095614 | 10/1982 | United Kingdom | 100/240 |

OTHER PUBLICATIONS

Trade Brochure from Heil Co., 8/1977, pp. 3, 4, 24–39, 46, 52, 54.

*Primary Examiner*—Andrew M. Falik

*Attorney, Agent, or Firm*—Hill, Van Santen, Steadman & Simpson

[57] ABSTRACT

A trash compactor which is hydraulically actuated and which has a compactor blade which can be moved the full length of a truck body with a telescoping cylinder with one actuation of the cylinder and wherein one end of the cylinder is connected by a bracket to the rear end of the body of the truck and the other end of the cylinder extends into a nose portion of the compactor blade where it is attached with a bracket. A relatively low pressure hydraulic system actuates the compactor blade and a release valve limits the maximum pressure to which the system is subjected.

8 Claims, 2 Drawing Sheets

HYDRAULIC REFUSE COMPACTOR WITH CHANNEL GUIDED COMPACTOR BLADE

BACKGROUND OF THE INVENTION

1. Field of the Invention

This invention relates in general to refuse compactors and in particular to an improved refuse compactor blade and actuating system.

2. Description of the Prior Art

Prior Art compactor blades have been moved by a cylinder which must be repetitively extended and retracted so as to fully move the compactor blade. Also, hydraulic systems for prior art compactor blades have required very high pressures in the hydraulic system for actuating the compactor blade. The present invention uses lower pressure then the prior art devices and provides lower friction of the compactor blade.

SUMMARY OF THE INVENTION

The present invention comprises an improved hydraulically actuated compator blade wherein a compactor blade is moveable in the body of a truck with a telescoping cylinder which has one end attached to the rear of the truck body with a bracket and has its other end mounted in a nose or extension formed in the compactor blade and wherein it is attached with a bracket. The hydraulic system extends and retracts the extendible hydraulic cylinder and operates at relatively low pressure as compared to prior art devices. A relief valve is connected in the pressure system so as to limit the hydraulic pressure and also to control the resistance of the compactor blade. The invention also utilizes extensions of the compactor blade which extend down into a depression and is slideably moveable therein. The edges of the extensions of the compactor blade have friction reducing rollers mounted thereon. Shoulders are formed above the rollers and lubricating layers such as low friction plastic is mounted between the rollers of the compactor blade and the shoulders and sidewalls of the depressions so as to substantially reduce the friction and to reduce the pressure of the hydraulic system.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
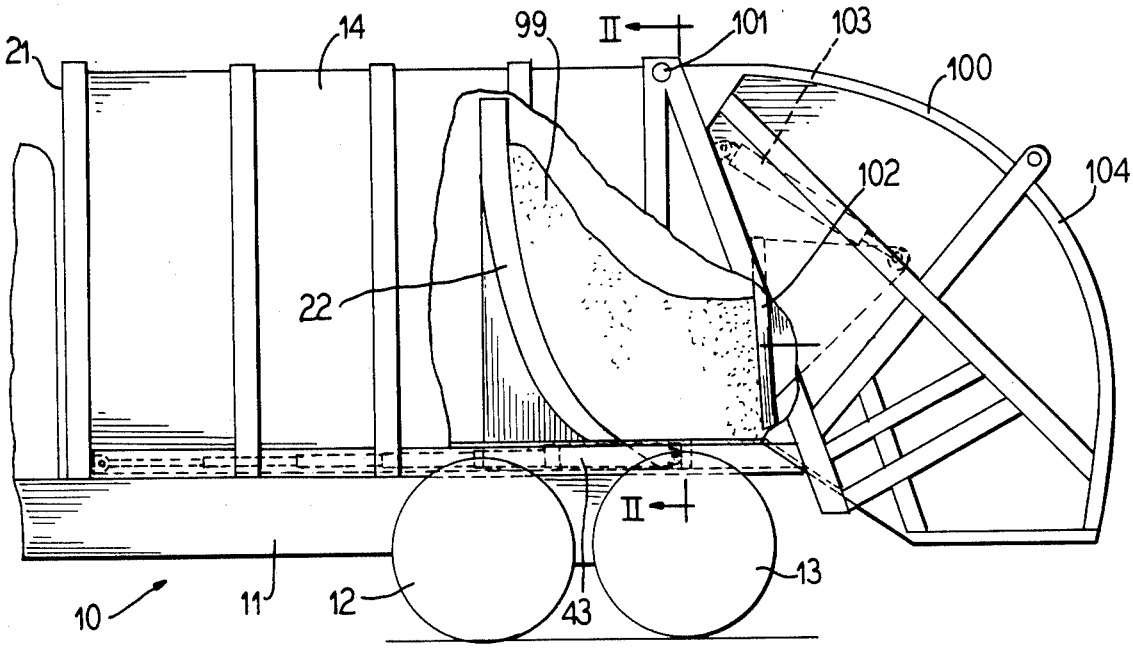
FIG. 1 is a partially cut-away side plan view of a compactor blade and mounted in the body of a truck.
Figure 2:
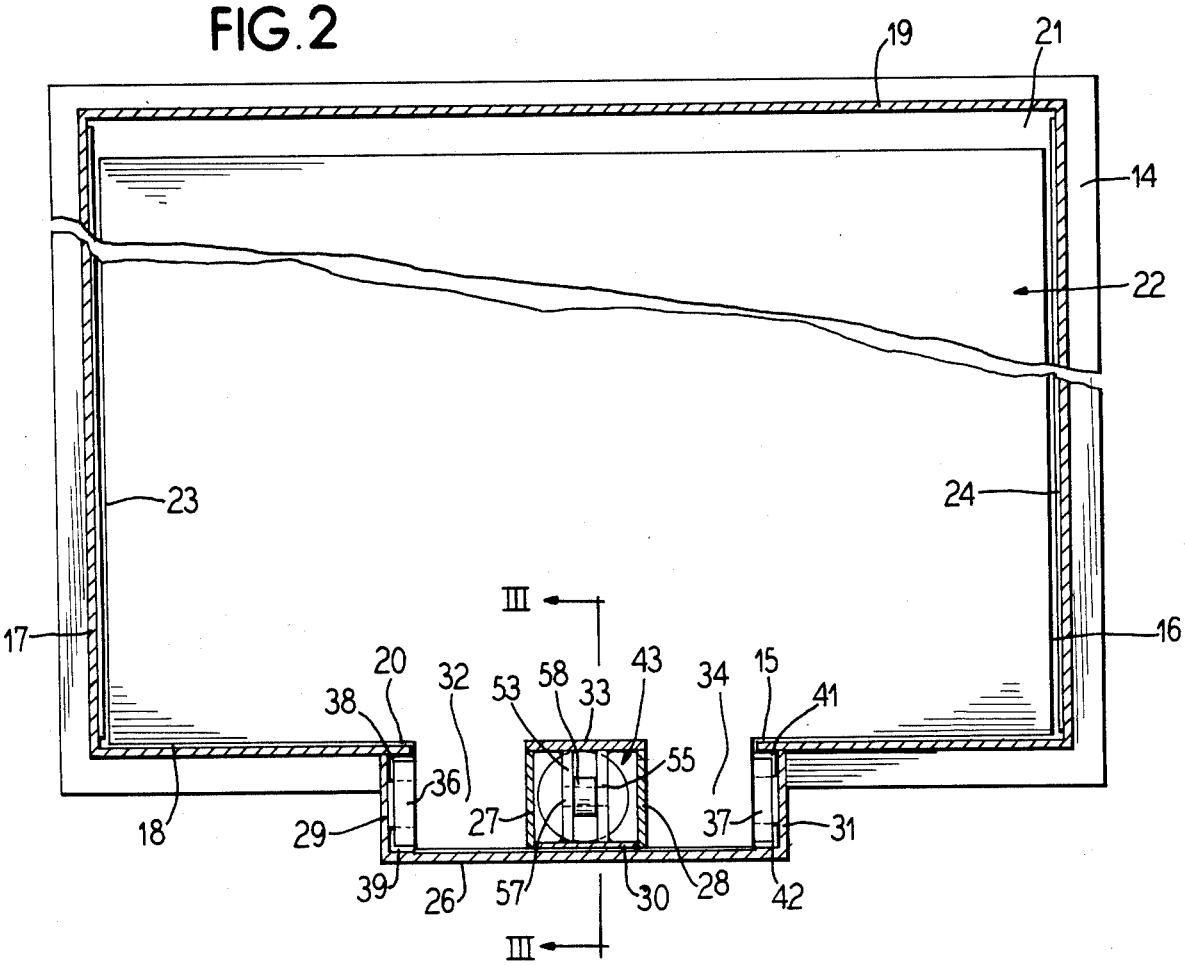
FIG. 2 is a sectional view taken on line II—II from FIG. 1.

FIG. 1 illustrates a truck 10 which has a frame 11 and ground wheels 12 and 13 upon which a refuse body 14 is mounted which has a front wall 21. As shown in FIG. 2, the body 14 has a top wall 19 and side walls 16 and 17 and a bottom wall 18. ,In the center of the bottom wall, there is formed a channel or depression of downwardly extending members 29 and 31 which are joined by bottom member 26 and in which the compactor blade 22 is mounted for moveable motion. The upper portion of the compactor blade 22 is curved as shown in FIG. 1 and it extends substantially across the inside surface of the body 14 and has a centrally located extension which includes downwardly extending portions 32 and 34 and a nose portion 35 which extends from the front portion of the compactor blade which is located in the channel. Said nose portion is formed of bottom member. 30, side members 27 and 28 and a top member 33.

As shown in FIG. 1, a hopper 100 is pivotably connected at pivot point 101 to the rear portion of the truck body 14 and includes a moveable hopper compactor blade 102 which is mounted and actuated by hydraulic cylinder 103 so as to compact and move refuse which has been placed in the hopper 100 through an opening 104 into the truck body 14 and against the compactor blade 22. In other words, in a conventional manner, the blade 102 compacts refuse 99 between the blade 22 and the blade 102 and as the volume of the refuse 99 becomes larger and larger, the compactor blade 22 is moved to the left relative to FIG. 1 by the compacted refuse 99 against holding hydraulic pressure. The compactor blade 22 is formed with a pair of guide members 36 and 37 which are mounted beneath extensions 15 and 20 of the bottom member 18 and lubricating layers 38 and 39 and 41 and 42 are mounted between guide members 36 and 37 and the bottom of the truck body as shown in FIG. 2. The guide members 36 and 37 are mounted on extensions of blade 22 and comprise first and second friction reducing members which are rollers. The lubricating layers 38 and 39 and 41 and 42 may be layers of low friction plastic which are mounted between the first and second friction reducing roller members and are attached to the first and second shoulders 15 and 20 on opposite sides of the depression and are attached to the sidewalls 29 and 31 of the depression.

Figure 3:
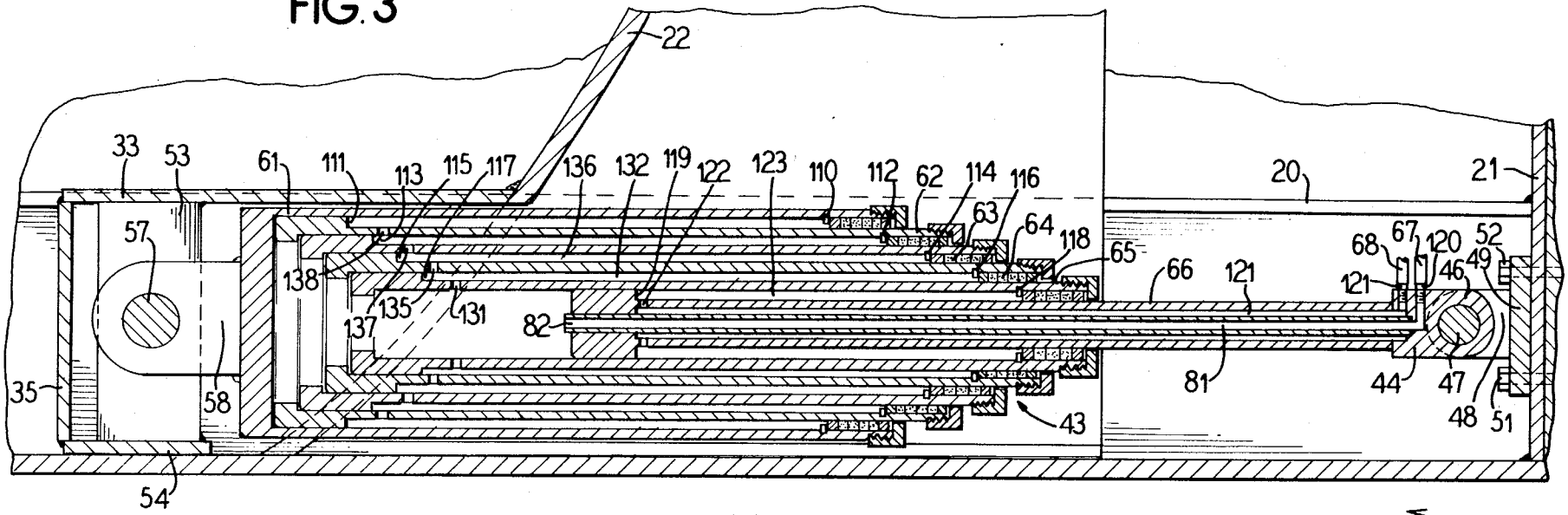
FIG. 3 is a sectional view taken on line III—III in FIG. 2.
Figure 4:
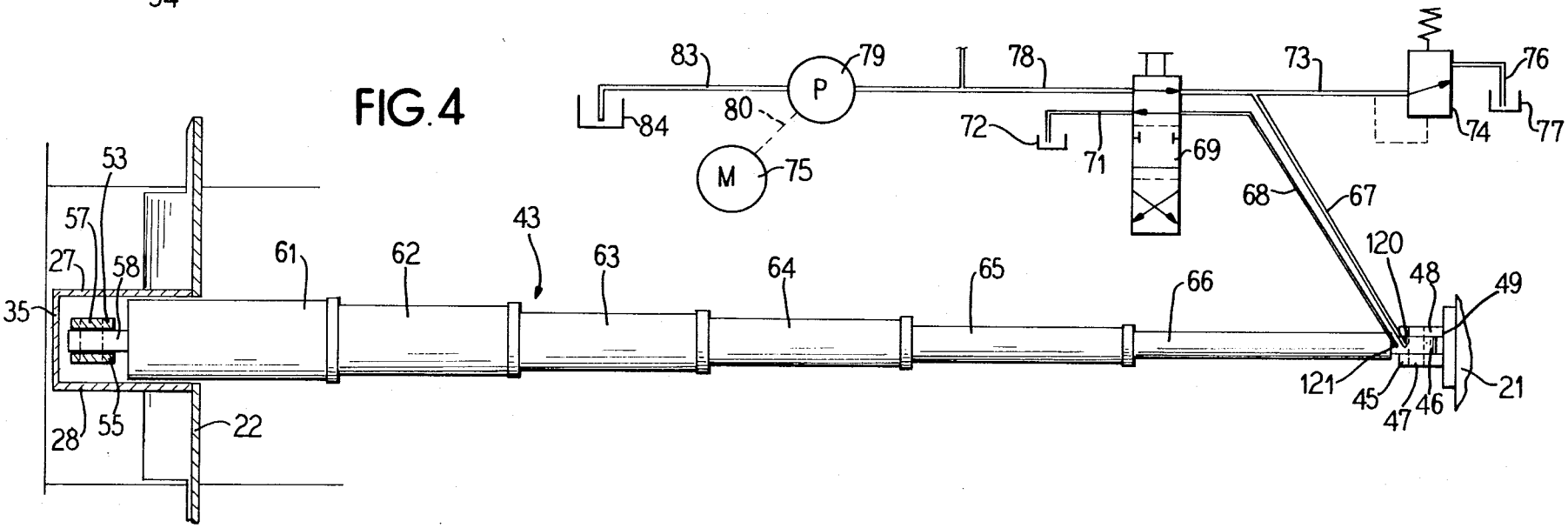
FIG. 4 is a view illustrating the hydraulic system of the invention.

A telescoping cylinder 43 is mounted in the lower portion of the truck body and is attached to the rear wall 21 by a bracket 49 as illustrated, for example, in FIGS. 3 and 4. The bracket 49 has a pair of extending plates 45 and 48 formed with openings through which a pin 47 extends and a first end of the extendible cylinder 43 has a section 66 to which is attached an extending plate 46 formed with a mating opening through which the pin 47 extends so as to lock one end of the cylinder to the members 45 and 48 and to the front end 21 of the body 14.

The other end of the hydraulic cylinder 43 has a section 61 which has an extending plate 58 formed with an opening through which a pin 57 extends to lock the member 58 to a pair of bracket members 53 and 55 attached to the nose portion to the extending nose of the compactor blade 22 which is formed by the members 33, 30, 27, 28 and 35. The bracket members 53 and 55 may be welded between the members 30 and 33 as shown in FIG. 2, for example.

Between the members 61 and 66 of the telescoping cylinder 43 are mounted telescoping cylindrical members 62, 63, 64 and 65 as shown in FIG. 4.

The hydraulic actuating system is shown in FIG. 4 wherein a fluid reservoir 84 supplies fluid to a line 83 which supplies a pump 79 driven by a motor 75 with a shaft 80. The line 78 from the pump supplies a control 69 which is connected by line 73 to a relief valve 74 which can be adjusted to a selected pressure and which has a relief outlet 76 which supplies fluid to a reservoir 77 that may be connected to the reservoir 84. The output of the control 69 is also connected by line 67 which is connected to an input orifice 120 which extends through cylindrical member 66. The orifice 120 is connected to a conduit 81 which extends through the member 66 as shown in FIG. 3 and has an outlet 82 which during expansion of the cylinder 43 supplies fluid into the interior of the hydraulic cylinder 43. As the cylinder 43 is expanded to drive the compactor blade 22, the fluid passes from line 67 through input orifice 120 through conduit 81 and out opening 82 where it exerts pressure on the cylinder members 66, 65, 64, 63, 62 and 61 so as to expand the cylinder until it is ultimately at the position illustrated in FIG. 4.

When the cylinder is to be retracted, the control 69 is actuated by the operator so that the control 69 changes the input and output ports of the control so that hydraulic fluid from line 78 passes through the control 69 into a line 68 which is connected to inlet orifice 121 where it passes through an opening 121 and cylindrical member 66 and out orifice 122 to apply pressure in a chamber 123 between the shoulder 119 on the inside of cylinder member 66 and a shoulder 118 on cylindrical member 65. This will cause cylindrical member 65 to move to the right relative to FIG. 3 until an orifice 131 in cylindrical member 65 is in communication with chamber 123 which will then allow fluid to pass into space 132 and there exert force between the shoulders 117 and 116 to cause cylindrical portion 64 to retract. When it retracts an orifice 135 in cylindrical portion 64 will be aligned with the chamber 132 and supply fluid under pressure to chamber 136 to retract the next cylindrical member. Orifices 137 and 138 cause the retraction of all of the cylindrical members 61 through 66 and FIG. 3 illustrates the telescoping cylinder in the partially retracted position. It is to be realized that during the retraction cycle, the fluid within the cylinders 61 through 66 passes into the opening 82 through the orifice 81 and out the opening 120 into line 67 to the control 69 where it is supplied by a line 71 to the reservoir 72. It is to be realized, of course, that the reservoir 72 may be connected or comprises reservoir 84. Thus, means are provided for extending and retracting the cylinder 43 so as to move the compactor blade 22 back and forth in the truck body 14.

It is to be realized that when the body 14 is empty, the compactor blade 22 is at the full extended position with the cylinder 43 extended to the position shown in FIG. 4. As refuse is placed into the hopper 100, the blade 102 forces the refuse 99 against the compactor blade 22 to compact it and when the force of the refuse 99 exceeds the setting of the relief valve 74, the relief valve 74 will open and allow hydraulic fluid to pass through the line 67 and 73 through the relief valve 74 into line 76 and to the reservoir 77 plus allowing the blade 22 to move to the left relative to FIG. 1. This operation will be repeated until the body 14 is full of refuse 99 at which time the compactor blade will have been moved to the left relative to FIG. 1 until it is adjacent the end wall 21. Then the truck is taken to a dumping cite and the hopper 101 is pivoted upwardly about the pivot point 101 and the control 69 is actuated so as to extend the cylinder 43 to move the compactor blade 22 from the left to the right relative to FIG. 1 so as to empty the refuse 99 from the truck body 14. Then the hopper 101 is returned to the position shown in FIG. 1 and the cycle is repeated.

The present invention provides a telescoping cylinder which during contraction and expansion moves the blade 22 the full length of the body 14. Note, that the largest portion 61 of the cylinder fits into the nose of the blade. Also, the cylinder is actuated with relatively low pressure and without requiring alternating extension and retraction of the cylinder so as to extend the blade. Also one end of the cylinder is connected to the blade with the nose formed of walls 27, 28, 30, 33 and 35 which cause smooth and positive action.

Although the invention has been described with respect to preferred embodiments, it is not to be so limited as changes and modifications can be made which are within the full intended scope of the invention as defined by the appended claims.

We claim as our invention:

1. A refuse body comprising a front wall, a pair of side walls and a bottom wall, a compactor blade formed with a downwardly extending extension substantially centrally located on a bottom edge thereof, a hollow nose portion mounted on said extension, said bottom wall formed with a depression and said compactor blade extension receivable in said depression, a multiple section telescoping hydraulic cylinder with one end connected to said front wall and the other end extending into said nose of said extension and connected to said nose, first and second friction reducing members connected to the sides of said extention of said compactor blade and engageable with opposite side walls of said depression, and hydraulic control means for extending and retracting said telescoping hydraulic cylinder.

2. A refuse body according to claim 1 wherein said hydraulic control means includes a conduit in which a source of pressurized hydraulic fluid is contained connectible to said telescoping hydraulic cylinder and a pressure relief valve connected to said conduit so as to limit the pressure of said hydraulic fluid to a predetermined maximum valve.

3. A refuse body according to claim 2 wherein said pressure relief valve is adjustable so as to preset the maximum pressure limit.

4. A refuse body according to claim 1 wherein said first and second friction reducing members comprise first and second rollers rotatably connected to opposite sides of said extension of said compactor blade.

5. A refuse body according to claim 4 wherein said bottom wall of said body is formed with first and second shoulders on opposite sides of said depression which extend over said first and second friction reducing members of said compactor blade.

6. A refuse body according to claim 5 including a layer of low friction plastic mounted between said first and second friction reducing members and said first and second shoulders and said opposite side walls of said depression.

7. A refuse body according to claim 1 wherein said one end of said telescoping cylinder is connected to said front wall with a first bracket.

8. A refuse body according to claim 7 wherein said other end of said telescoping cylinder is connected to said compactor blade inside said nose by a second bracket.

* * * * *